United States Patent [19]

Perea

[11] Patent Number: 4,705,426

[45] Date of Patent: Nov. 10, 1987

[54] SECURITY AND DEFENSE BARRIER

[76] Inventor: Bernabe A. Perea, Rte. 145 Box 250A, Santa Fe, N. Mex. 87505

[21] Appl. No.: 810,500

[22] Filed: Dec. 19, 1985

[51] Int. Cl.[4] ..... E01F 13/00

[52] U.S. Cl. ..... 404/6; 49/33; 49/131

[58] Field of Search ..... 404/6, 11; 49/33, 49, 49/131, 133; 256/1

[56] References Cited

U.S. PATENT DOCUMENTS

| | | | |
|---|---|---|---|
| 1,960,376 | 5/1934 | Gilman | 404/6 |
| 3,266,013 | 8/1966 | Schmidt | 340/31 |
| 3,805,448 | 4/1974 | Carr et al. | 49/131 X |
| 4,158,514 | 6/1979 | Dickinson | 404/6 |
| 4,318,079 | 3/1982 | Dickinson | 340/127 |
| 4,332,503 | 6/1982 | Hurst, Jr. | 404/11 |
| 4,354,771 | 10/1982 | Dickinson | 404/6 |
| 4,490,068 | 12/1984 | Dickinson | 404/6 |
| 4,577,991 | 3/1986 | Rolow | 404/6 |
| 4,624,600 | 11/1986 | Wagner et al. | 404/6 |

FOREIGN PATENT DOCUMENTS

| | | | |
|---|---|---|---|
| 20978 | 1/1935 | Australia | 404/6 |
| 3134247 | 3/1983 | Fed. Rep. of Germany | 49/49 |
| 158884 | 3/1957 | Sweden | 49/131 |

*Primary Examiner*—James A. Leppink
*Assistant Examiner*—Matthew Smith
*Attorney, Agent, or Firm*—Rodey, Dickason, Sloan, Akin & Robb

[57] ABSTRACT

A security and defense barrier which comprises a vault buried within and transverse to the roadway. The vault has within a latched plurality of barrier arms that may be raised by any powered means, or manually, and the raised barrier arms being positioned within the vault so that impact forces are transmitted directly to the vault, and to a foundation, and little or no load is supported by a pivoting mechanism. Being very strong, the barrier can be made capable of stopping a speeding vehicle. The raised barrier arms have a hook on the end so that a speeding vehicle attacking the barrier will be snagged, and prevented from inadvertently or intentionally vaulting the barrier.

5 Claims, 2 Drawing Figures

SECURITY AND DEFENSE BARRIER

BACKGROUND

1. Field of the Invention

This invention relates generally to traffic control barriers, and more specifically to positive traffic control on roadways in potentially hazardous areas leading to restricted or secure installations.

2. Description of the Prior Art

Traffic barriers have been known for quite some time. Probably the most common are those which control traffic into and out of paid parking lots. DICKINSON, U.S. Pat. No. 4,318,079 typifies this type of traffic barrier. This DICKINSON and DICKINSON, U.S. Pat. No. 4,158,514 both use a spiked device to puncture tires of an offending vehicle, a form of disablement. Another form of disablement of offending vehicles is taught by SCHMIDT, U.S. Pat. No. 3,266,013. SCHMIDT teaches a hook mechanism which is supposed to reach out and snare the bumper of an offending vehicle and thereby preventing its further travel in the wrong direction. Other traffic barriers employ, not disablement but annoyance, such as DICKINSON, U.S. Pat. No. 4,490,068 and DICKINSON, U.S. Pat. No. 4,354,771 as well as GILMAN, U.S. Pat. No. 1,960,376. All of the above barriers and all the other known barriers permit the impact forces to be born by the pivot mechanisms, and therefore are for controlling normal traffic of citizenry. None of the prior art suggests a positive traffic barrier wherein the vehicle is to be stopped, regardless of the damage to the vehicle, or the occupants.

SUMMARY

Recent terrorist activities against U.S. embassies and military installations have pointed out a need for a positive traffic control device, wherein the vehicle can be stopped regardless of the speed of the vehicle or the intentions of the driver or other occupants. This means that the barrier must be very strong and capable of withstanding severe impact loads, and should provide a positive attaching mechanism so that vehicles cannot, intentionally or inadvertently, vault the barrier. Furthermore, vehicles which are intended to be crashed through a barrier are usually, or can be, travelling at relatively high vehicular speeds. This reduces to a requirement that the barrier be positionable in a very short time. Thus it is an objective of this invention to provide a very strong barrier, which is able to be raised as fast as the projected threat anticipates will be required, and the barrier is to preclude inadvertent as well as intentional vaulting of the barrier, and will inflict severe damage to a vehicle challenging the barrier, even if the barrier partially fails.

DESCRIPTION OF THE PREFERRED EMBODIMENT

Figure 1:
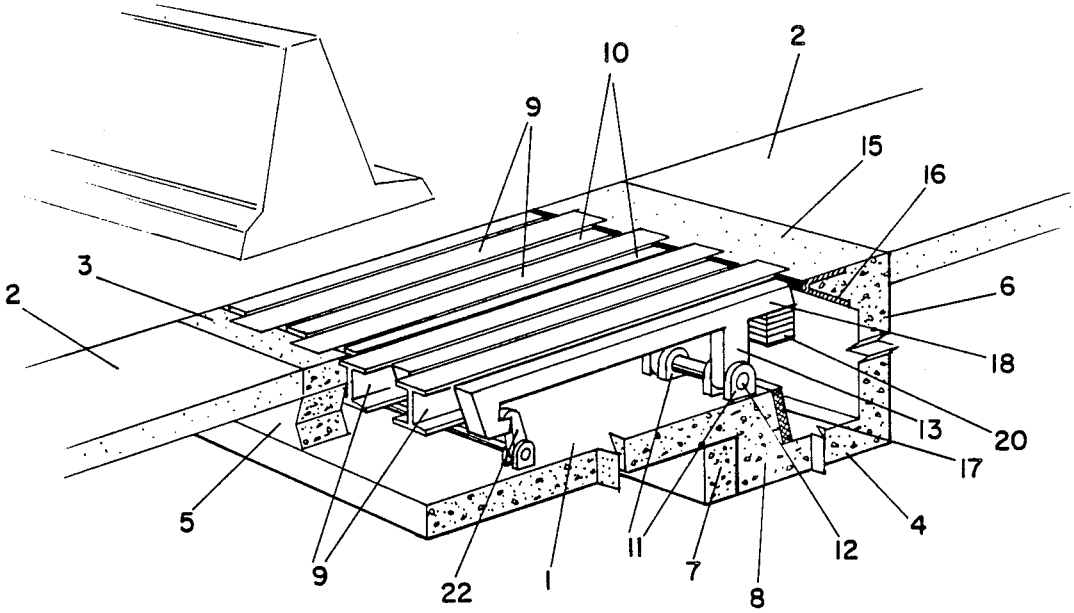
FIG. 1 is an isometric view of the invention installed in a roadway.
Figure 2:
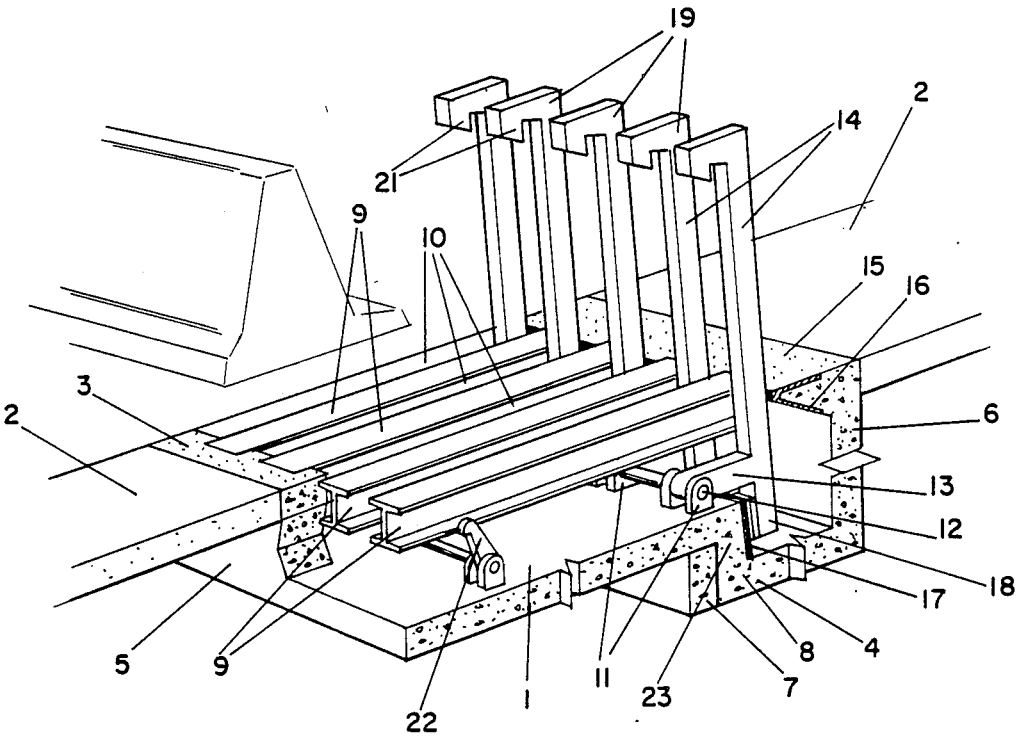
FIG. 2 is a vertical longitudinal cross section of the invention.

As shown in FIG. 1, the invention is a security and defense barrier having a vault 1 which is buried in the roadway 2, from side-to-side, or in other words, the barrier extends from one side of the roadway 2 to the other side. The vault 1 has a top 3, a bottom 4, an approach end 5, and a shoulder end 6. The vault 1 is generally shaped as an open box, and is made of concrete, reinforced as required. The bottom of the vault 1 has a step 8 wherein the vertical surface of the step 8 is designated the rise 23. The vault 1 is level with the surface of the roadway 2. Across the top 3 of the vault 1 from the shoulder end 6 to the approach end 5 are beams 9. The beams 9 are supported by the approach end 5 and the shoulder end 6 of the vault 1, and the beams 9 are evenly spaced and parallel with each other so that normal vehicular traffic can cross the barrier without impediment, and between the beams 9 are spaces 10. The vault 1 is placed on a foundation 7 which runs transverse and across the roadway 2. The step 8 fits onto and against the foundation 7 so that the rise 23 of the step 8 abuts against the side of the foundation 7 and the foundation 7 is toward the approach end 5 of the vault 1 from the rise 23. In this manner the vault 1 is prevented from moving toward the approach end 5. The shoulder end 6 has a shoulder 15 which protrudes from the shoulder end 6 towards the approach end 5 of the vault 1. The shoulder 15 is protected from impact forces by a sheath 16 of impact resistant material such as steel. On the inside bottom 4 of the vault 1, adjacent to the approach end 5 is a plurality of spring loaded latches 22. Mounted on the inside bottom 4 of the vault 1 above the foundation 7 are a plurality of pivot supports 11. Rotatably passing through the pivot supports 11 is a pivot rod 12. Rigidly attached at one end to the pivot rod 12 are a plurality of pivot arms 13. Rigidly attached to the other ends of the pivot arms 13 are the barrier arms 14. The pivot arms 13 and the barrier arms 14 are assembled to the pivot rod 12 so that as the pivot rod 12 is turned, the barrier arms 14 pass through the spaces 10. Inside the vault 1 on the rise 23 is a pad 17 which is also made of impact resistant material such as steel. The barrier arms 14 have a butt end 18 and a hook end 19. As the barrier arms 14 are raised by turning the pivot rod 12, the butt end 18 lowers into the vault 1 and contacts the pad 17. At a point on the butt end 18 of the barrier arm 14 where it will contact the pad 17 is a counterweight 20. Simultaneously, as the butt end 18 contacts the rise 23, the barrier arm 14 is also contacting the sheath 16. The hook end 19 of the barrier arm 14 is so called because on its end there is a dual purpose hook 21. If a vehicle were to challenge the barrier with the barrier arms 14 raised, and impact on it, the hooks 21 would snag parts of the vehicle and stop it; and if the vehicle were to attempt to vault the barrier, the hooks 21 would hold the vehicle as a fish on a fish hook, and if the vehicle were to get free, the hooks 21 would tear the vehicle doing great damage. When the barrier arms 14 are secured inside the vault 1, the hooks 21 are engaged by the spring loaded latches 22 positively keeping the barrier arms 14 from raising. When assembled, the barrier arms 14 are weighted so that when the barrier arms 14 are secured in the vault 1 the barrier arms 14 are nearly balanced on the pivot rod 12. As the barrier arms 14 are raised by turning the pivot rod 12, the center of gravity of the barrier arms 14 shifts towards the shoulder end 6 aiding the barrier arms 14 to raise.

When a vehicle impacts the barrier with the barrier arms 14 raised, the entire impact load is taken by the barrier arms 14 and transmitted directly to the shoulder 15 and the foundation 7 through the rise 23. None of the impact load is taken by the pivot supports 11, pivot rod 12, or the pivot arms 13. When the barrier arms 14 are made of material having the strength of a short section of railroad track, the barrier would stop even a locomotive. In the raised position, the barrier arms 14 are not quite vertical, but tilted towards approaching traffic. The vicious hook 21, combined with the strength of the barrier arms 14, will impale almost any vehicle, do it severe damage, and stop the vehicle in its tracks.

The bottom 4 of the vault 1 because it is exposed to the environment should be sloped from the approach end 5 down towards the shoulder end 6, and the bottom 4 of the vault 1 adjacent to the shoulder end 6 should be sloped down towards the sides of the roadway 2. The vault 1, the pivot rod 12, and the barrier arms 14, as well as the latch 22 may be heated or dried as the weather dictates. If conditions are not too severe, frequent lubrication and exercising of the barrier should be sufficient to prevent any binding of the pivot rod 12 or the barrier arms 14 and the latch 22.

The projected threat of terrorist attack by type and weight and speed of vehicle, as well as the particular terrain features of the site will dictate the size and type of mechanism for raising the barrier arms 14. The barrier arms 14 may be raised by electrical motors, hydraulic power, stored energy such as accumulators, or manually as well as by counter balance by weights 20. If the projected threat dictates a fast rise time for the barrier arms 14, then the control mechanism should be electric from a command post such that one signal would unlatch the barrier arms 14 and activate the power means to raise the barrier arms 14. The power means could be attached directly to one or both ends of the pivot rod 12, for example. The variety of available power means for raising the barrier arms 14 is so large, and the specific requirements of each site so different that this invention does not reach to a particular means to raise the barrier arms 14. However, once raised, there are two obvious methods to lower the barrier arms 14 into the vault 1. If the power means to raise the barrier arms 14 is reversible, then lowering the barrier arms 14 is simple. However, the barrier arms 14 may be both raised and lowered manually by attaching a long handled wrench to the pivot rod 12 and rotating the pivot rod 12 manually until the barrier arms 14 are in the desired position.

Finally, this preferred embodiment has been describing the invention as if it were one unit all the way across the roadway 2. Indeed, this may well be the case, however, the invention may as well be prefabricated in units of convenient width which are placed side-by-side and the units joined functionally so that a series of units completely crosses the roadway 2. While the roadway 2 may be positively protected by the barrier, it is also necessary to consider the sides of the roadway 2 and to prevent a vehicle from going around the barrier. Since normal traffic does not travel around on the sides of a roadway 2, a permanent barrier from the ends of the present invention to as far as is deemed advisable under local terrain constraints is the easiest and best solution. A permanent earthen barrier of sufficient height and depth may be all that is required. The so-called Iowa barriers may also be used, since these are easy to fabricate, are inexpensive, and somewhat portable.

I claim:

1. A security and defense barrier comprising:

(a) a vault which is buried in a roadway, said vault including a top, a bottom, an approach end, and a shoulder end, in the bottom of the vault there being a step, the vertical surface of the step being designated a rise;

(b) a foundation which is under the approach end of the vault and disposed transverse to the roadway, the rise abutting against the foundation to prevent the barrier from moving during operation of the barrier;

(c) a plurality of beams spaced apart parallel to each other between shoulder end and the approach end, said beams being able to support normal vehicular traffic thereacross;

(d) a plurality of non-impact bearing pivot supports mounted on the bottom and inside of the vault transverse to the roadway;

(e) a pivot rod which rotatably extends through the plurality of pivot supports;

(f) a selected plurality of pivot arms, each said pivot arm having a first end and a second end, said pivot arms being rigidly affixed at said first ends to said pivot rod;

(g) a like selected plurality of barrier arms rigidly attached to said secone ends of the pivot arms, the longitudinal axis of each barrier arms being substantially perpendicular to the longitudinal axis of each corresponding pivot arm, each said barrier arm having a top vehicular traffic supporting surface, a dual purpose hook end for latching and vehicular snagging, and a butt end, said barrier arms being seated in the spaces between the beams when the barrier arms are in a down position, the top surfaces of the barrier arms and the beams forming a substantially even surface, said hook ends being shaped to provide two sharp angles, each hook on the hook end facing downward and inward when the barrier arm is in a down position, the hook ends being shaped to snag, hold, or tear a vehicle, when provided, which may impact the barrier arms, and, when the pivot rods are rotated, the barrier arms are raised;

(h) counterweight and shock absorbing pad means for balancing somewhat and assisting in raising the barrier arms, said counterweight and shock absorbing pad means being attached to the barrier arms underneath their butt ends to abut against the rise when the barrier arms are raised to their fully raised position with the top surfaces of the barrier arms bracing against the shoulder end, said means thereby assisting in vehicular impact absorption;

(i) a plurality of latches mounted on the bottom of the vault adjacent to the approach end, said latches engaging and latching the hook ends; and (j) means for unlatching the latches from the hook ends to release and allow the barrier arms to rise;

wherein during operation of the barrier, the barrier arms are initially locked into a down position which is parallel to the beams by the latches which are engaged with the hook ends of the barrier arms, when the vehicle to be stopped approaches the approach end, the spring latches release the barrier arms, the counterweight and shock absorbing pad means at the butt ends of the barrier arms assist the barrier arms to rotate on the pivot arms about the pivot supports and the hook ends of the barrier arms to be raised, the barrier arms being held in their upright position when the counterweight and shock absorbing pad means on the butt end contact the rise and the top surfaces contact the shoulder end, thereby positioning the barrier arms for stopping and damaging the vehicle.

2. A security and defense barrier in accordance with claim 1 wherein the exterior surfaces of said hook ends on each barrier arm are designed such that the top of the barrier arm and the end of the barrier arm form an angle of less than 90°, and the hook end of the barrier arm and the bottom surface of the hook form an angle of greater than 90°.

3. A security and defense barrier in accordance with claim 1 further comprising a pad which is affixed to the rise such that when the barrier arms are raised, the counterweight and shock absorbing means contact the pad, thereby improving the wearability of said means and rise.

4. A security and defense barrier in accordance with claim 1 further comprising a sheath on the shoulder end for improved wearability.

5. A security and defense barrier in accordance with claim 1 wherein the vault bottom is sloped from the approach end to the shoulder end, and wherein the bottom of the vault adjacent to the shoulder end slopes outward towards the edge of the roadway and away from the barrier.

* * * * *

UNITED STATES PATENT AND TRADEMARK OFFICE

CERTIFICATE OF CORRECTION

PATENT NO. : 4,705,426

DATED : November 10, 1987

INVENTOR(S) : Bernabe A. Perea

It is certified that error appears in the above-identified patent and that said Letters Patent is hereby corrected as shown below:

In field [76] on cover page of the Patent, change address from "Rte. 145 Box 250A, Santa Fe, N. Mex. 87505"

--Rte. 2 Box 250A, Santa Fe, N. Mex. 87501--.

In Claim 1, Column 4, line 21 of the Patent, change "secone" to --second--

Signed and Sealed this

Seventh Day of March, 1989

*Attest:*

DONALD J. QUIGG

*Attesting Officer*

*Commissioner of Patents and Trademarks*